US008154391B1

(12) United States Patent
Morris

(10) Patent No.: US 8,154,391 B1
(45) Date of Patent: Apr. 10, 2012

(54) DOOR BELL BUTTON MECHANISM

(76) Inventor: Eric D. Morris, Philadelphia, PA (US)

( * ) Notice: Subject to any disclaimer, the term of this patent is extended or adjusted under 35 U.S.C. 154(b) by 547 days.

(21) Appl. No.: 12/112,472

(22) Filed: Apr. 30, 2008

Related U.S. Application Data

(60) Provisional application No. 60/915,525, filed on May 2, 2007.

(51) Int. Cl.

| | |
|---|---|
| ***G08B 5/00*** | (2006.01) |
| *H01H 9/00* | (2006.01) |
| *H01H 5/06* | (2006.01) |
| *F21V 33/00* | (2006.01) |

(52) U.S. Cl. ..... 340/332; 340/330; 200/296; 200/314; 200/310; 200/462; 362/95

(58) Field of Classification Search ..... 340/332; 200/296

See application file for complete search history.

(56) References Cited

U.S. PATENT DOCUMENTS

| | | | | |
|---|---|---|---|---|
| 2,951,138 | A * | 8/1960 | Petrino | 200/330 |
| 4,126,774 | A * | 11/1978 | Gossling | 200/314 |
| 4,447,685 | A * | 5/1984 | Ohashi et al. | 200/439 |
| 4,873,402 | A * | 10/1989 | Honda et al. | 200/283 |
| 4,910,368 | A * | 3/1990 | Honda et al. | 200/302.2 |
| 5,881,864 | A * | 3/1999 | Shelhorse | 200/296 |
| 6,180,905 | B1 * | 1/2001 | Pollock et al. | 200/527 |
| 2006/0219541 | A1 * | 10/2006 | Birdwell et al. | 200/310 |

* cited by examiner

*Primary Examiner* — George Bugg
*Assistant Examiner* — Jack Wang
(74) *Attorney, Agent, or Firm* — Caesar, Rivise, Bernstein, Cohen & Pokotilow, Ltd.

(57) ABSTRACT

A door bell button for activation of a door bell is provided which includes a mounting base for attachment to a surface adjacent to a door, a switch secured to the mounting base and having a lighted actuator plunger, and a translucent bell button shaft having a first end and a second end, the second end abutted against the lighted actuator plunger and slidably disposed and capable of limited movement along an axis perpendicular to the mounting base. Light from the lighted actuator plunger shines through the translucent bell button shaft to light the shaft.

8 Claims, 15 Drawing Sheets

DOOR BELL BUTTON MECHANISM

CROSS-REFERENCE TO RELATED APPLICATION

This application claims the benefit of U.S. Provisional Application Ser. No. 60/915,525, entitled Door Bell Button Mechanism, filed May 2, 2007.

BACKGROUND OF THE INVENTION

This invention relates to door bells. More specifically, this invention is directed to buttons for activating door bells or door chimes.

In common use, primarily for private residences, a lighted or unlighted switch is used for the bell button. The button is typically protected from physical abuse by a base plate and a decorative cover. The preferred bell button is lighted, rather than unlighted. Generally, lighted bell buttons commonly used today have a common switch such as a Trine 45LA or 45LG push button switch. In an attempt to prolong the life of the bell button, the manufacturer has added UV inhibitors to the exposed plastic translucent portion of the switch that is lighted. Over time, the plastic typically deteriorates due to exposure to sunlight and weather. The bell button may also be exposed to abuse from users who may press the button with any object at hand, preferably their fingers, but keys, screw drivers or other less desirable items may also be used to press the button. These less desirable items, combined with long term exposure to UV rays and weather will, over time, cause the plastic used in the button to deteriorate and break.

It would be beneficial to provide a bell button that does not use this weak link of a translucent button switch.

BRIEF SUMMARY OF THE INVENTION

A door bell button for activation of a door bell is provided which includes a mounting base for attachment to a surface adjacent to a door, a switch secured to the mounting base and having a lighted actuator plunger, and a translucent bell button shaft having a first end and a second end, the second end abutted against the lighted actuator plunger and slidably disposed and capable of limited movement along an axis perpendicular to the mounting base. Light from the lighted actuator plunger shines through the translucent bell button shaft to light the shaft.

Preferably, the actuator plunger is capable of movement along an axis perpendicular to the mounting base by a first length and the bell button shaft is capable of movement along the axis perpendicular to the mounting base by a second length, wherein the second length is shorter than the first length such that the actuator plunger is never fully depressed, thereby increasing the life of the switch.

The door bell button may include a cover secured to the mounting base by a hollow retaining ring. The first end of the translucent bell button shaft may be secured to a button paddle, and the second end of the translucent bell button shaft may be slidably disposed in the retaining ring such that the bell button shaft is captured by the retaining ring but is capable of the limited movement along the axis perpendicular to the mounting base.

A door bell button for activation of a door bell is also provided which includes a mounting base for attachment to a surface adjacent to a door, a switch rigidly secured to the mounting base having a lighted actuator plunger that moves along an axis perpendicular to the mounting base by a first length, a cover secured to the mounting base, a hollow retaining ring to secure the cover to the mounting base, and a translucent bell button shaft having a first end and a second end, the first end secured to a button paddle, the second end abutting the lighted actuator plunger, the shaft being slidably disposed in the retaining ring such that the bell button shaft is captured by the retaining ring but is capable of limited movement along the axis perpendicular to the mounting base. Light from the lighted actuator plunger shines through the translucent bell button shaft to light the shaft.

Preferably, the bell button shaft is capable of movement along the axis perpendicular to the mounting base by a second length, and the second length is shorter than the first length such that the actuator plunger is never fully depressed. The cover may be a decorative cover.

A method of installing a bell button for activation of a door bell is also provided which includes the steps of attaching a bell button mounting base to a surface adjacent to a door, rigidly securing a switch to the mounting base, the switch having a lighted actuator plunger that moves along an axis perpendicular to the mounting base by a first length, securing a first end of a translucent bell button shaft to a button paddle, and capturing the bell button shaft such that the bell button shaft is capable of limited movement along the axis perpendicular to the mounting base, whereby light from the lighted actuator plunger shines through the translucent bell button shaft to light the shaft.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
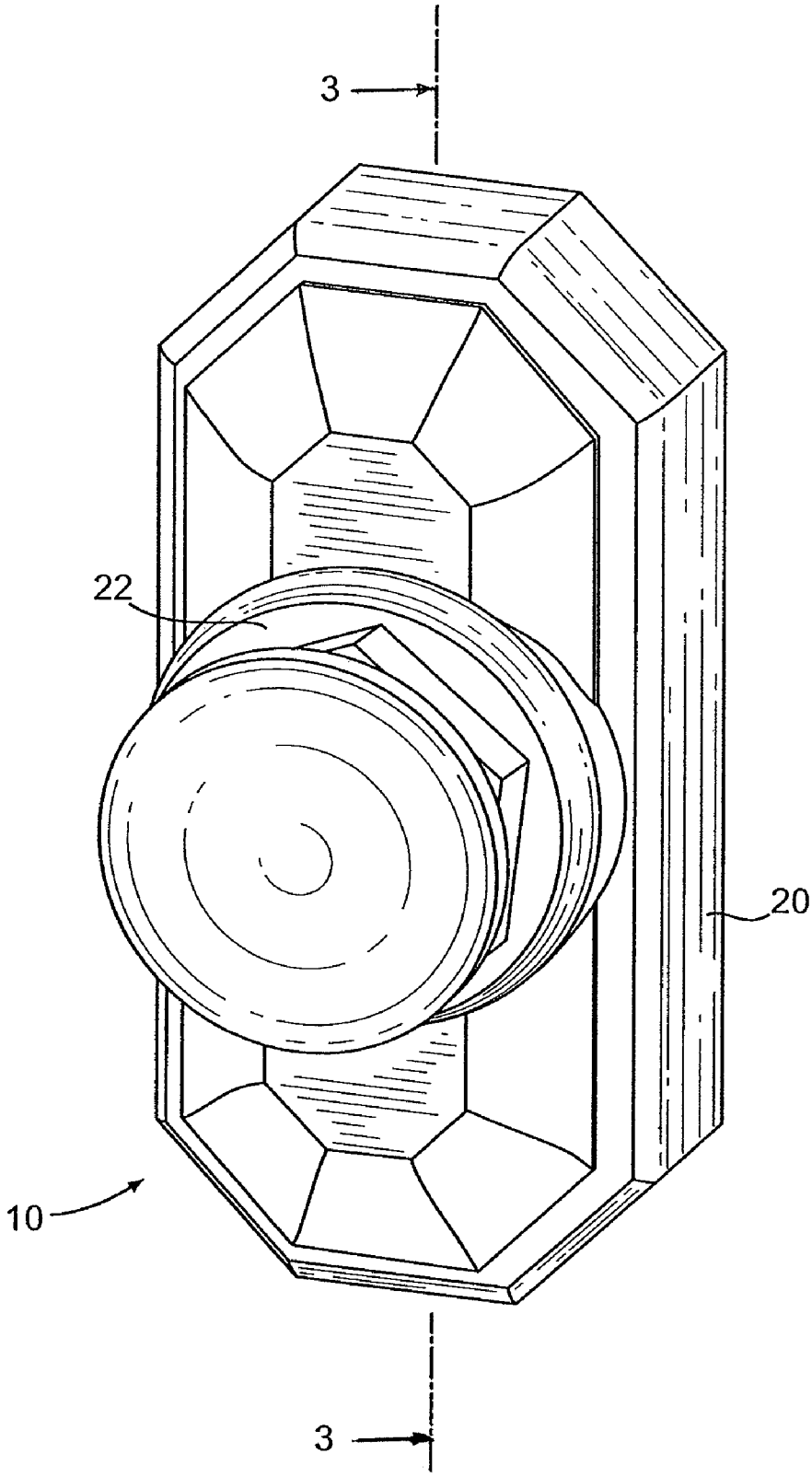
FIG. 1 is a front, isometric view of a door bell button for activation of a door bell in accordance with a preferred embodiment of the present invention.
Figure 2:
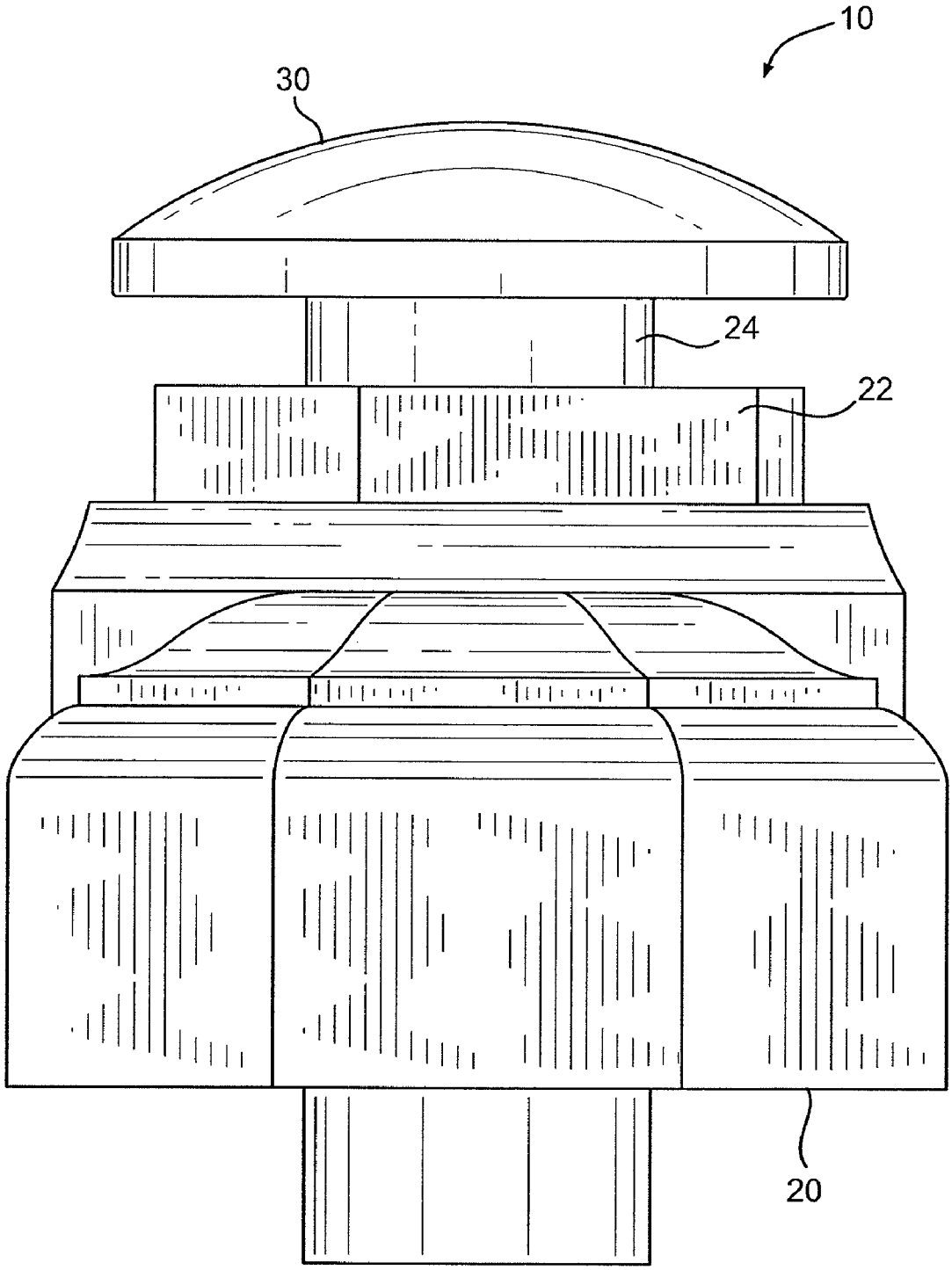
FIG. 2 is a side, elevation view of the door bell button of FIG. 1.
Figure 3:
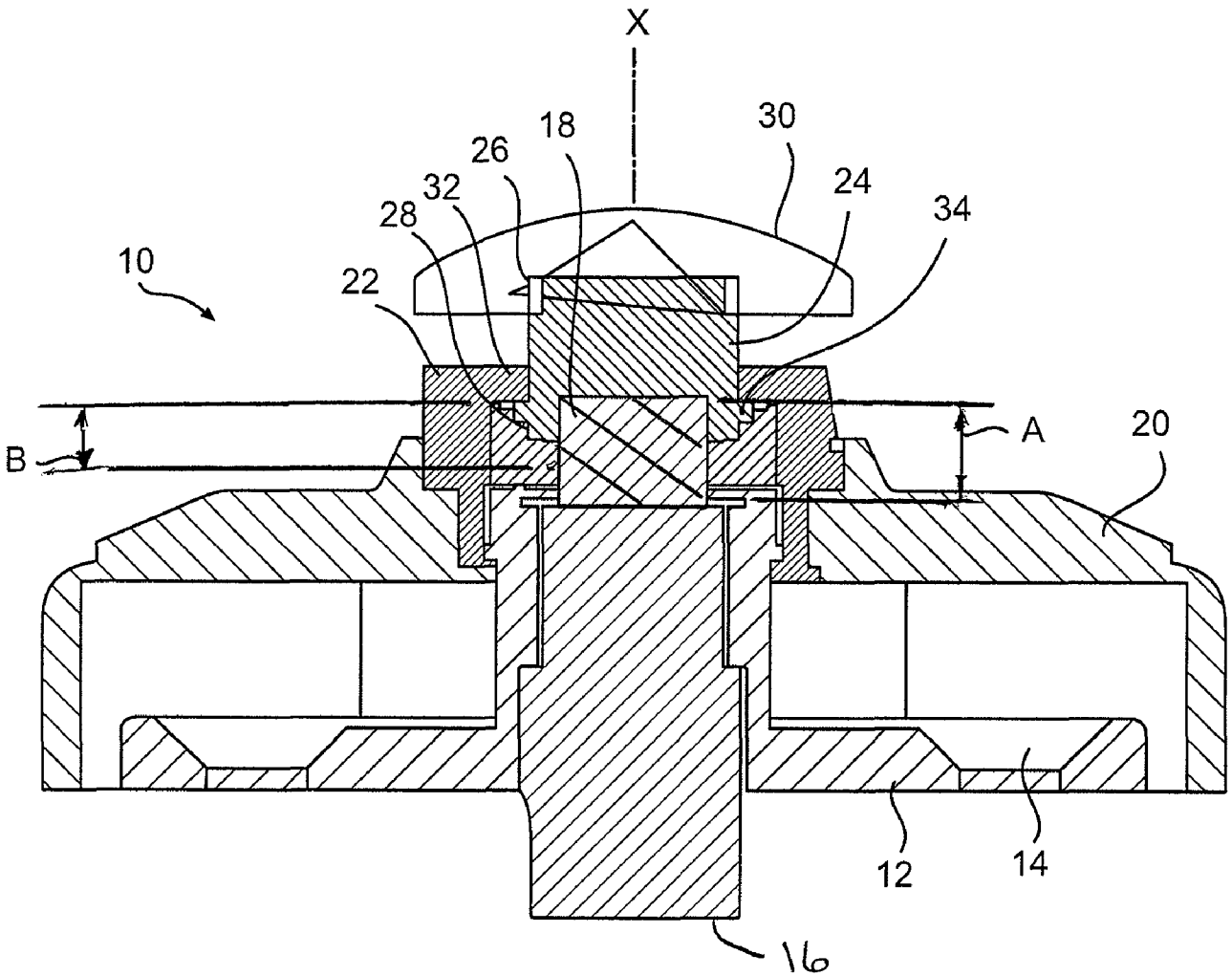
FIG. 3 is a cross-sectional side view of the door bell button of FIG. 1, taken substantially along lines 3-3 of FIG. 1.
Figure 4:
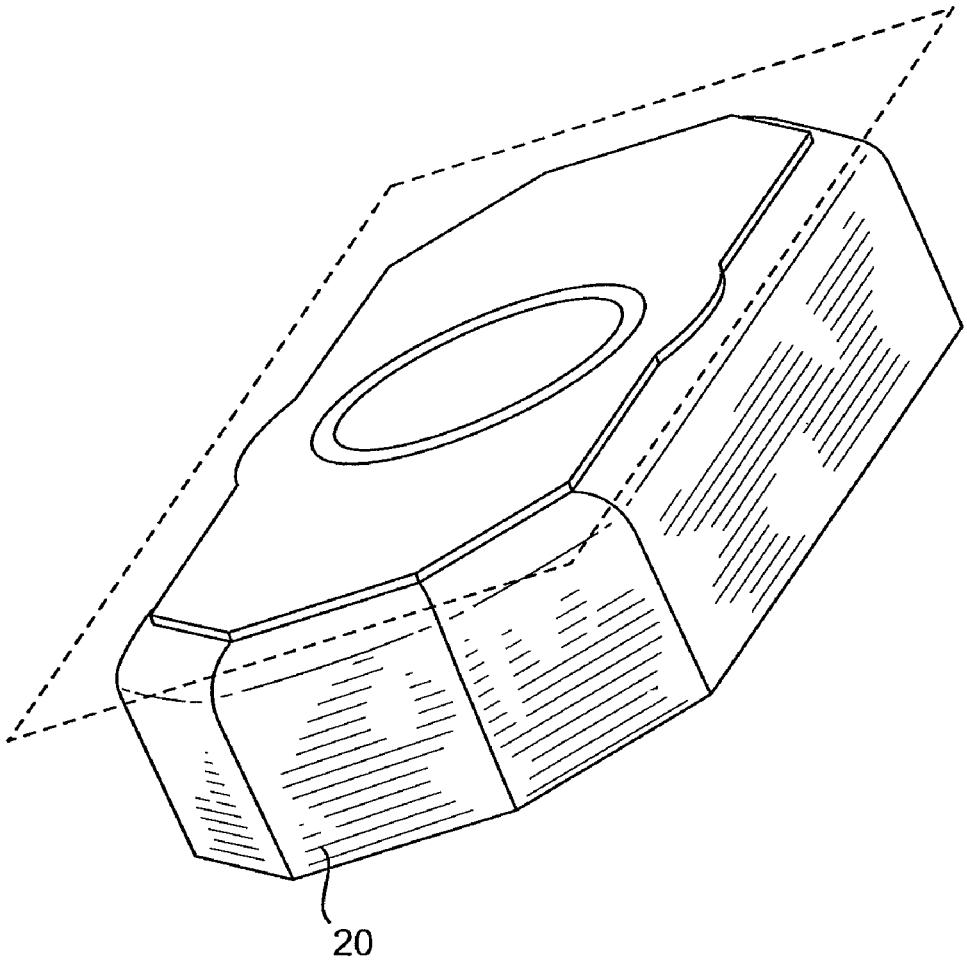
FIG. 4 is an isometric view of a decorative cover for use with the door bell button of FIG. 1.
Figure 4A:
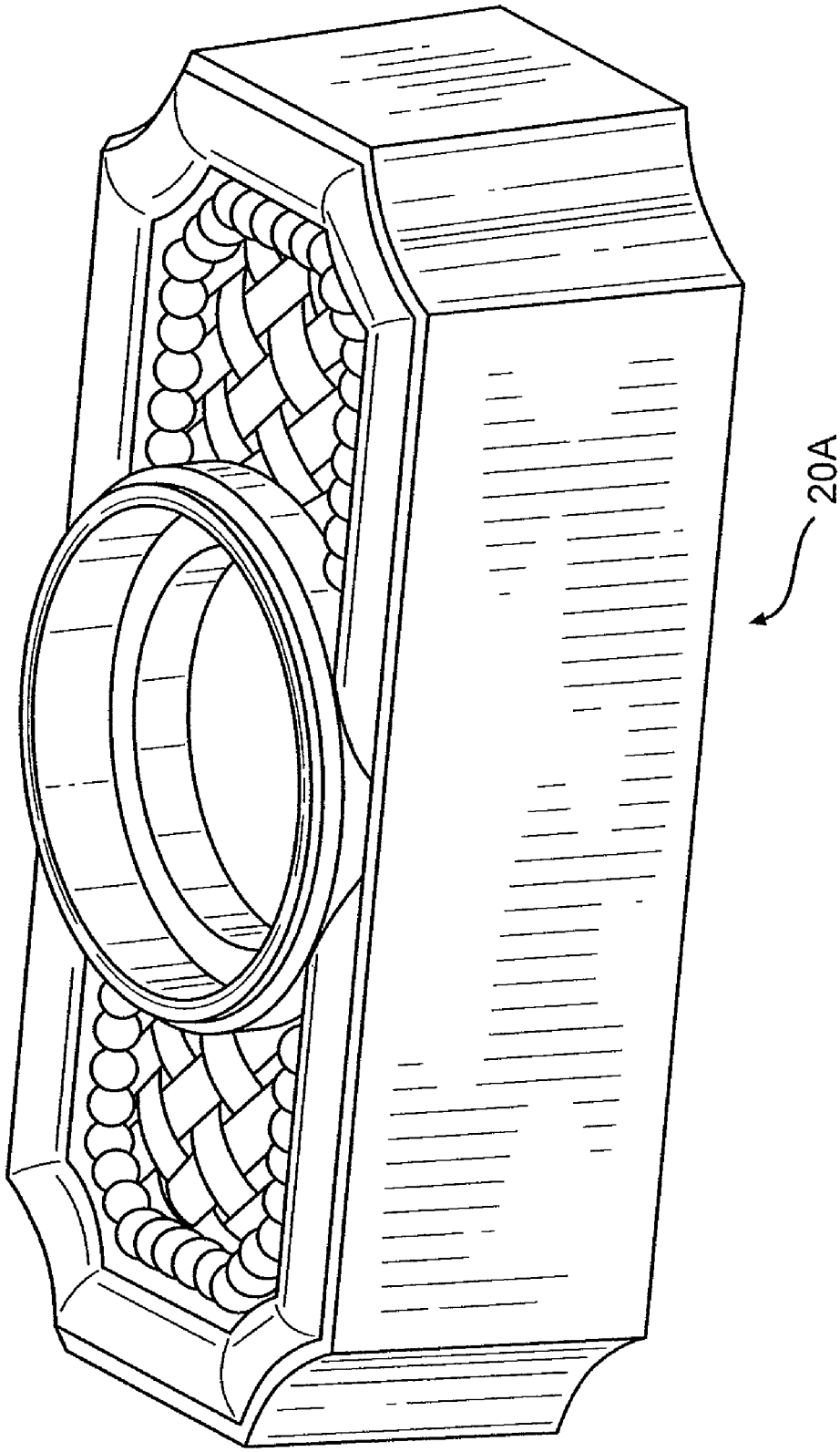
FIG. 4A is an isometric view of another decorative cover for use with the door bell button of FIG. 1.
Figure 5:
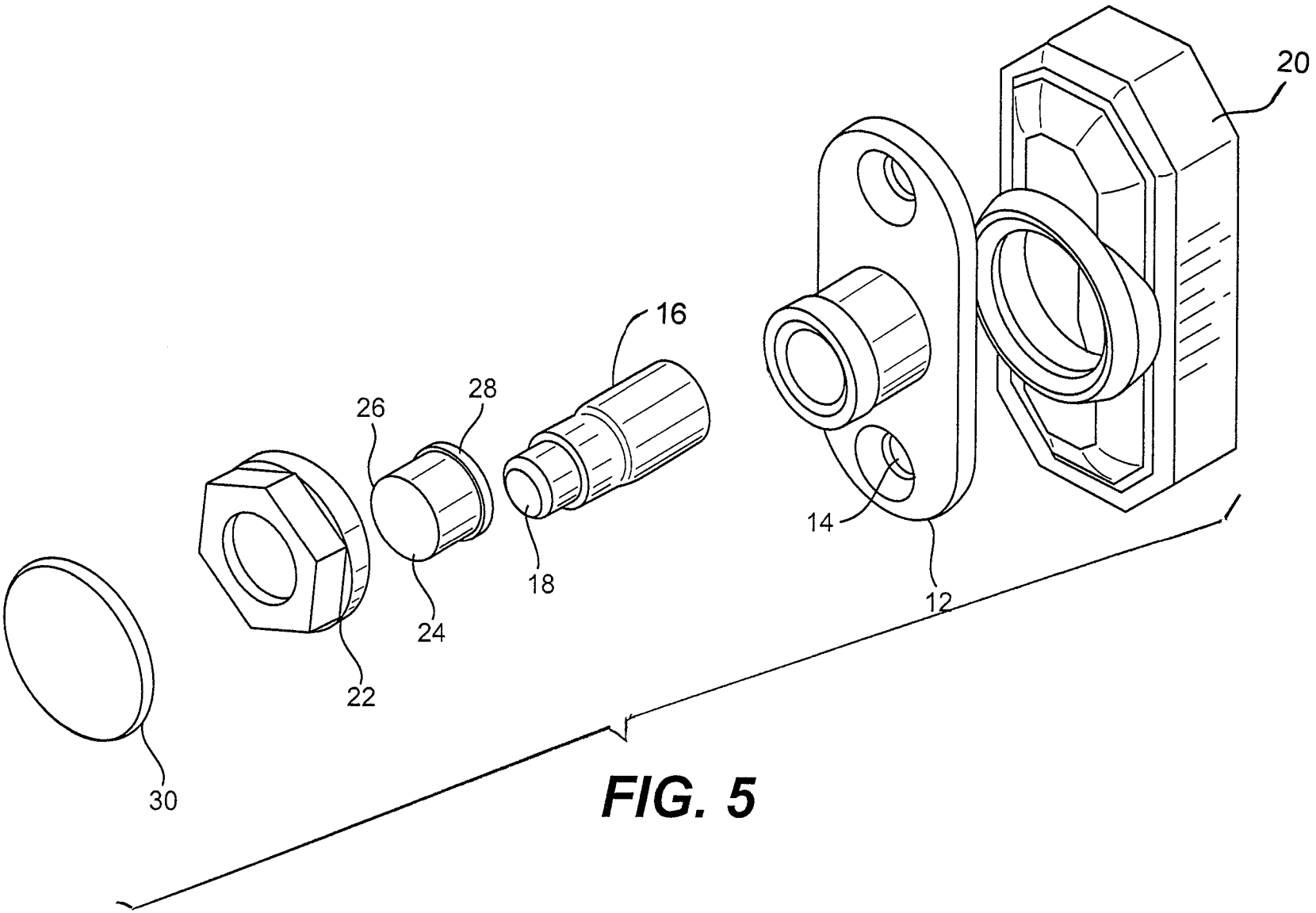
FIG. 5 is an exploded isometric view of the door bell button of FIG. 1.
Figure 6:
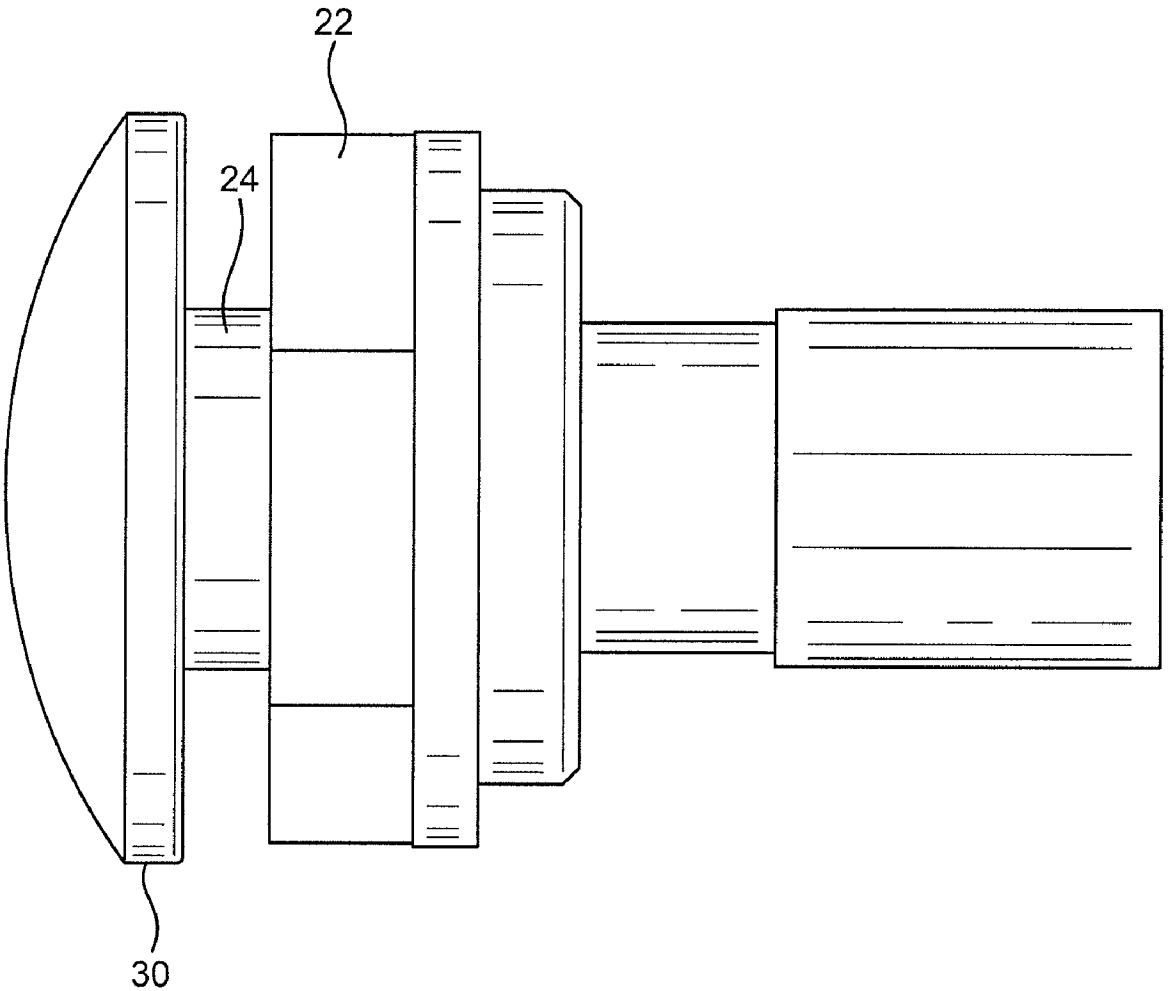
FIG. 6 is a side, elevation view of a switch, retaining ring, bell button shaft, and button paddle of the door bell button of FIG. 1.
Figure 7:
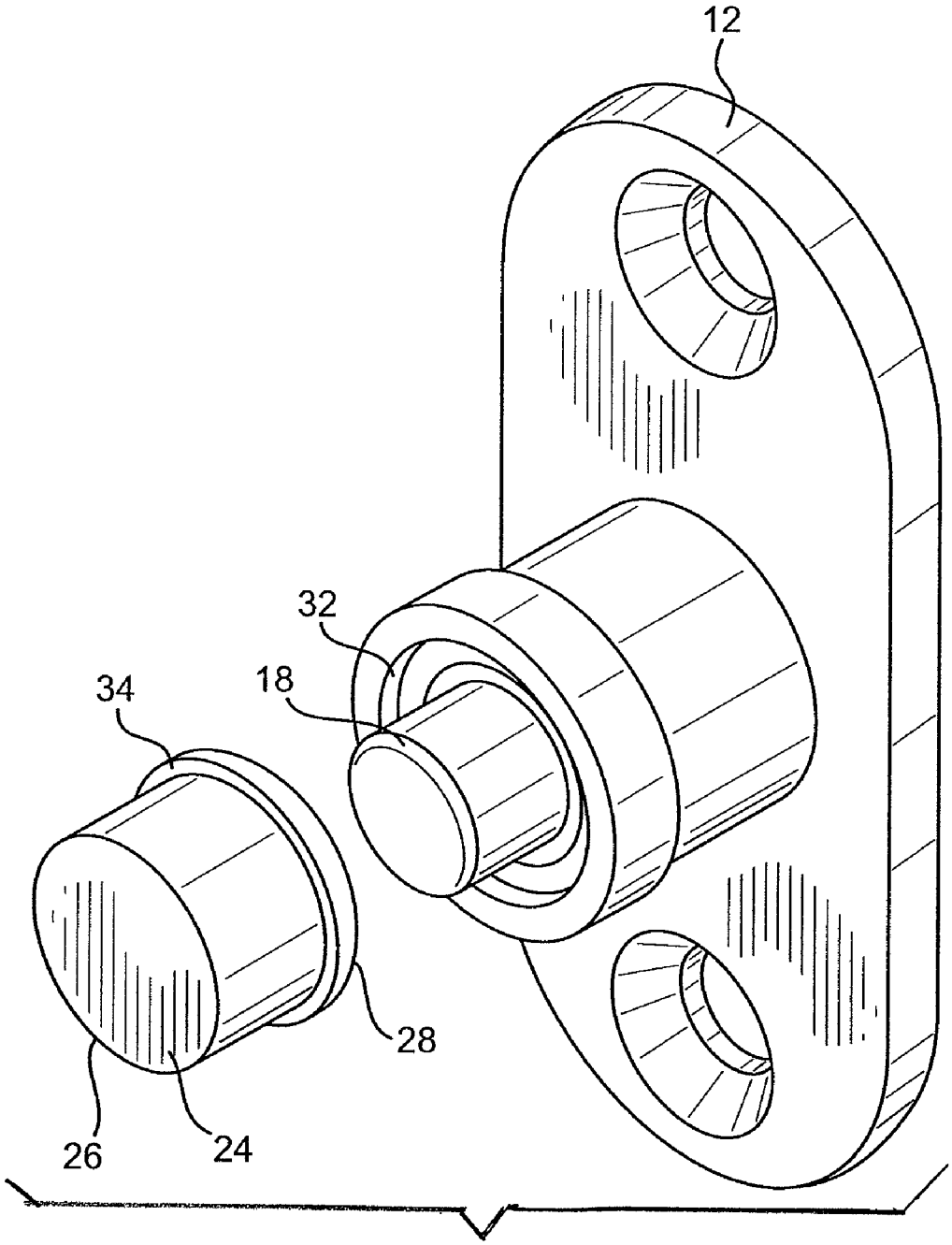
FIG. 7 is an isometric view of a switch, retaining ring, and bell button shaft of the door bell button of FIG. 1.
Figure 8:
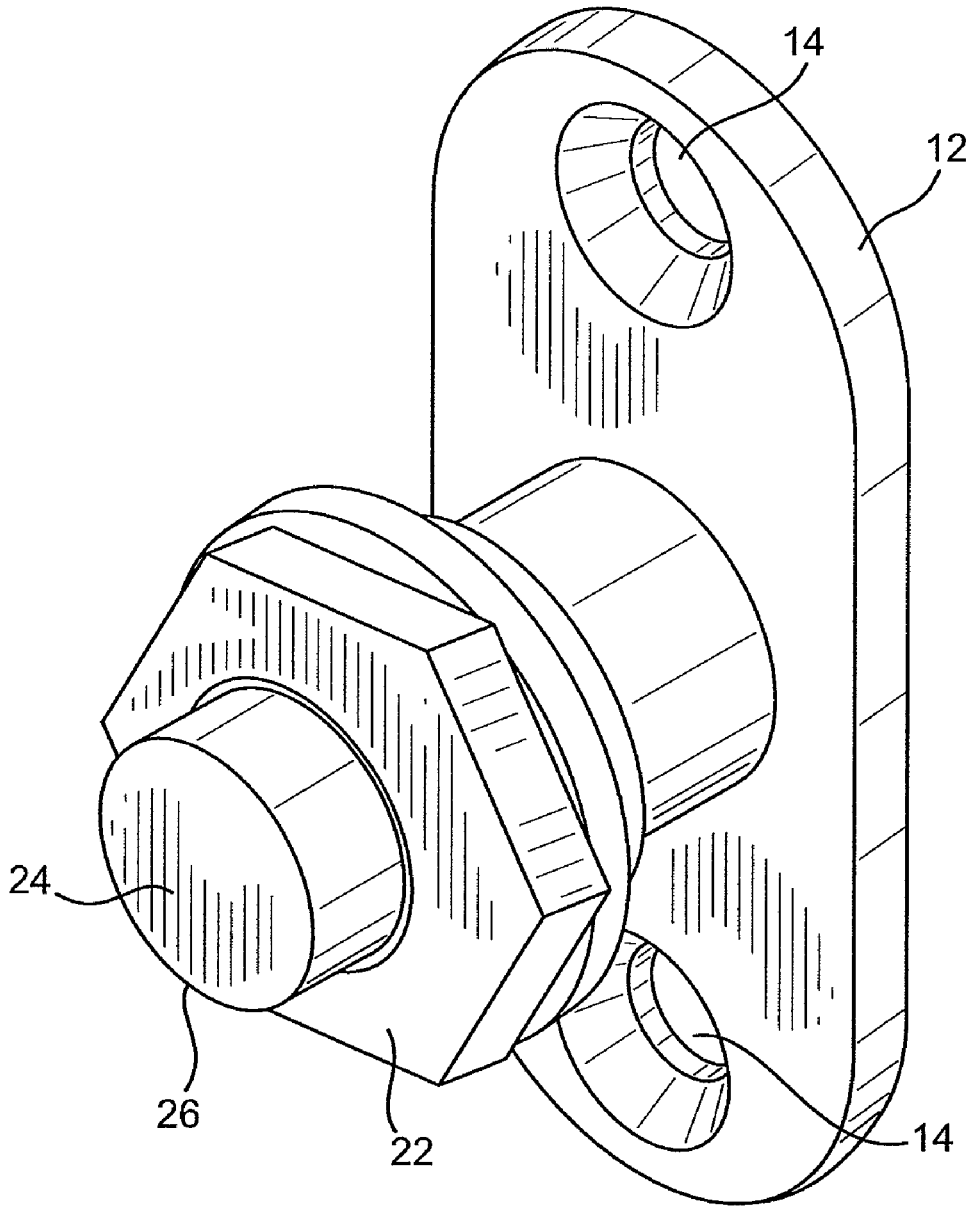
FIG. 8 is a perspective view of a base plate, switch, retaining ring and bell button shaft of the bell button of FIG. 1.
Figure 9:
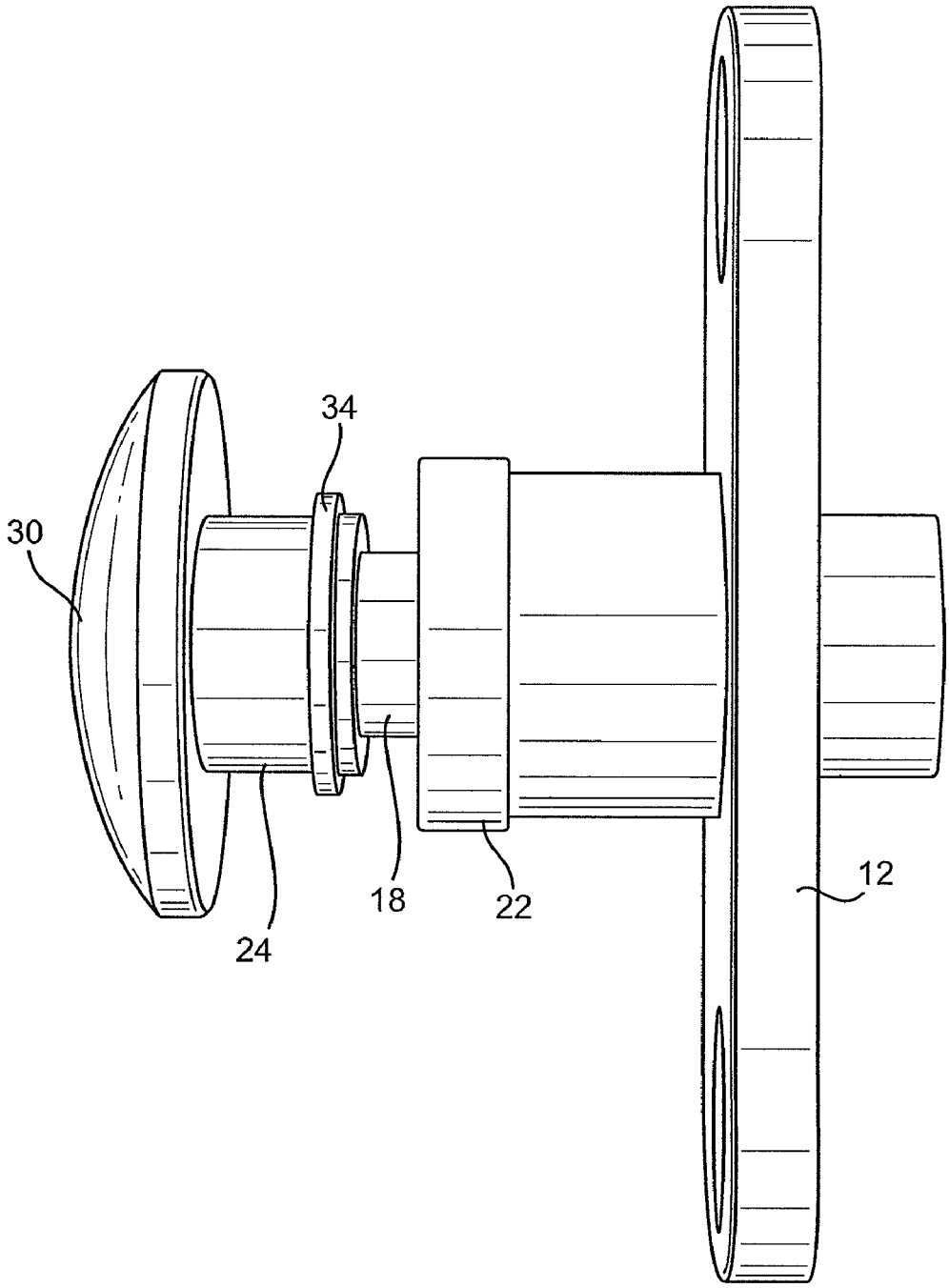
FIG. 9 is a side, elevation view of the base plate, switch, retaining ring, bell button shaft and button paddle of the bell button of FIG. 1.
Figure 10:
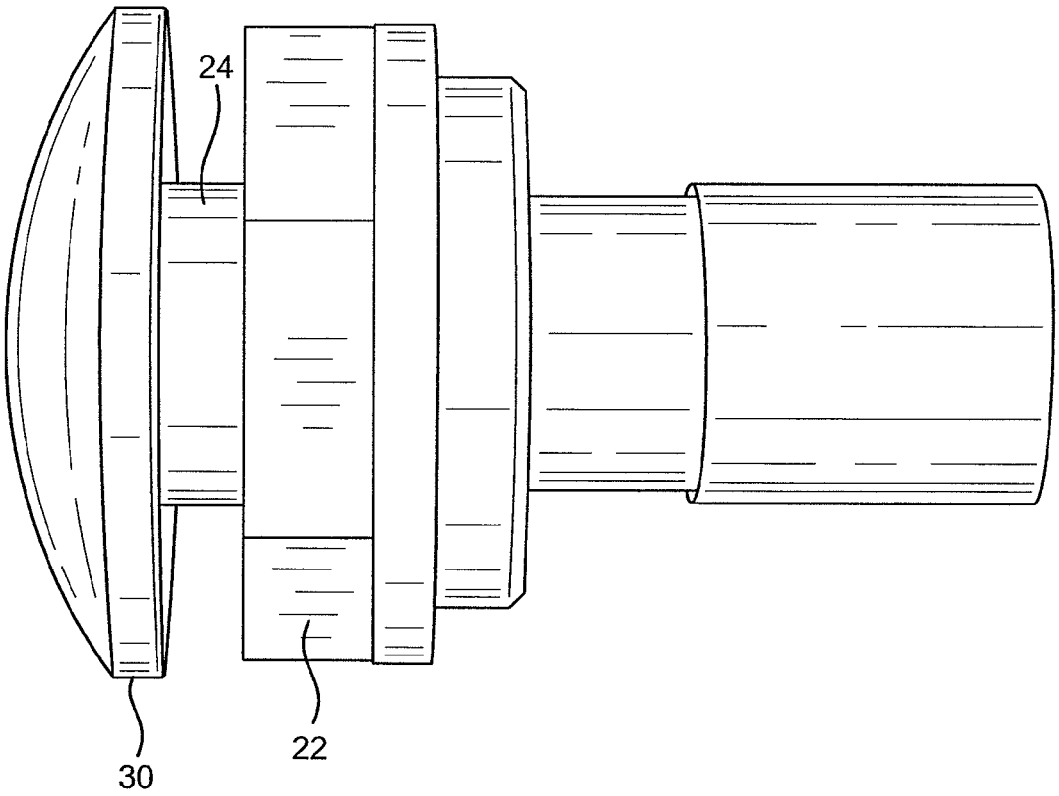
FIG. 10 is a side elevation view of the switch, retaining ring, bell button shaft and button paddle of the bell button of FIG. 1.
Figure 11:
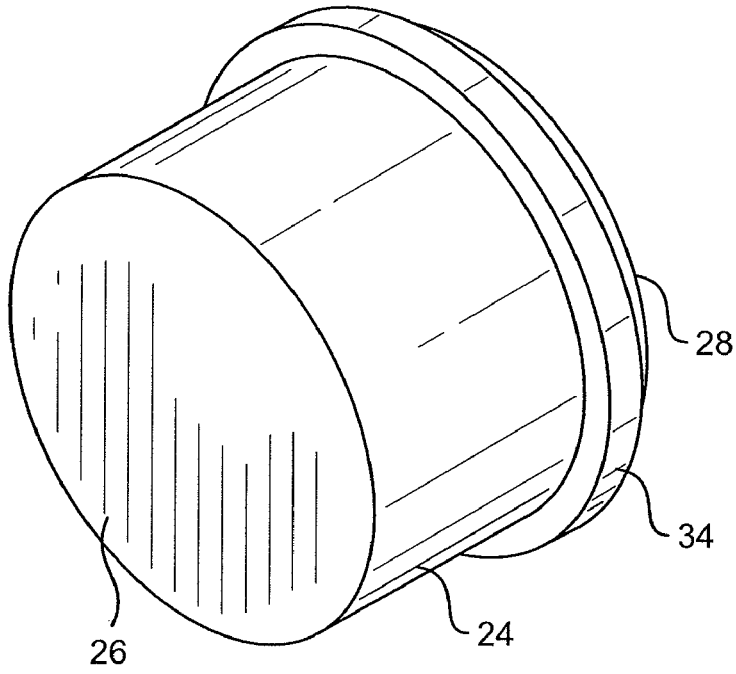
FIG. 11 is an isometric view of a bell button shaft of the bell button of FIG. 1.
Figure 12:
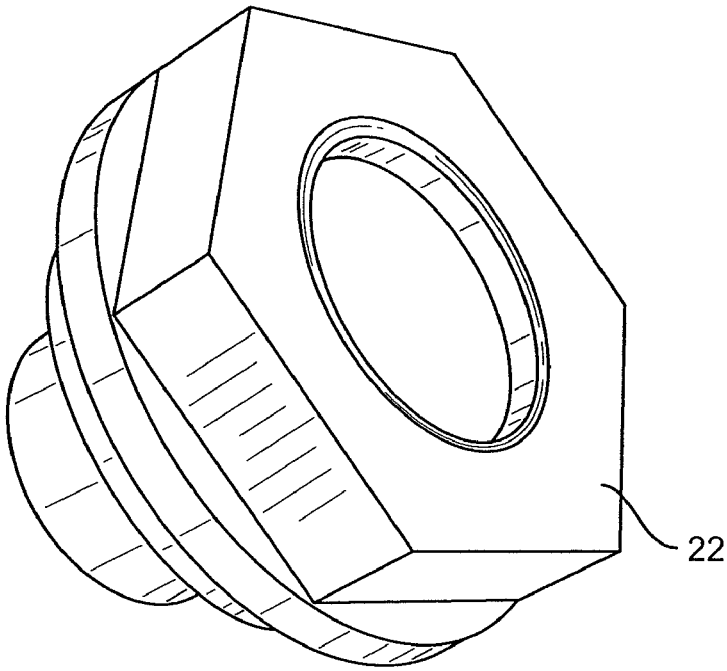
FIG. 12 is an isometric view of the retaining ring of the bell button of FIG. 1.
Figure 13:
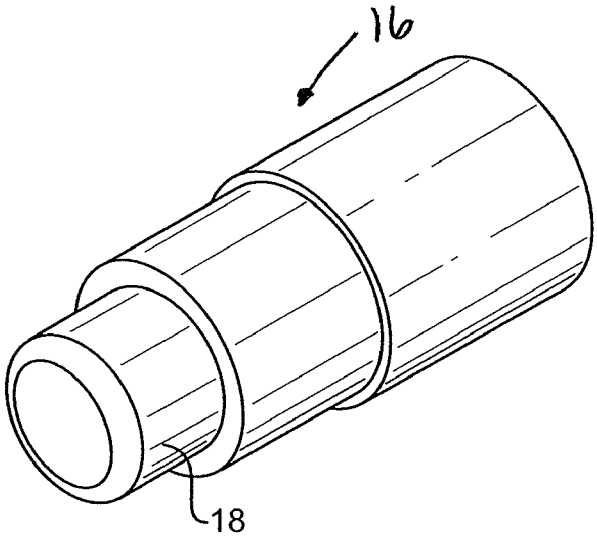
FIG. 13 is an isometric view of the switch of the bell button of FIG. 1.
Figure 14:
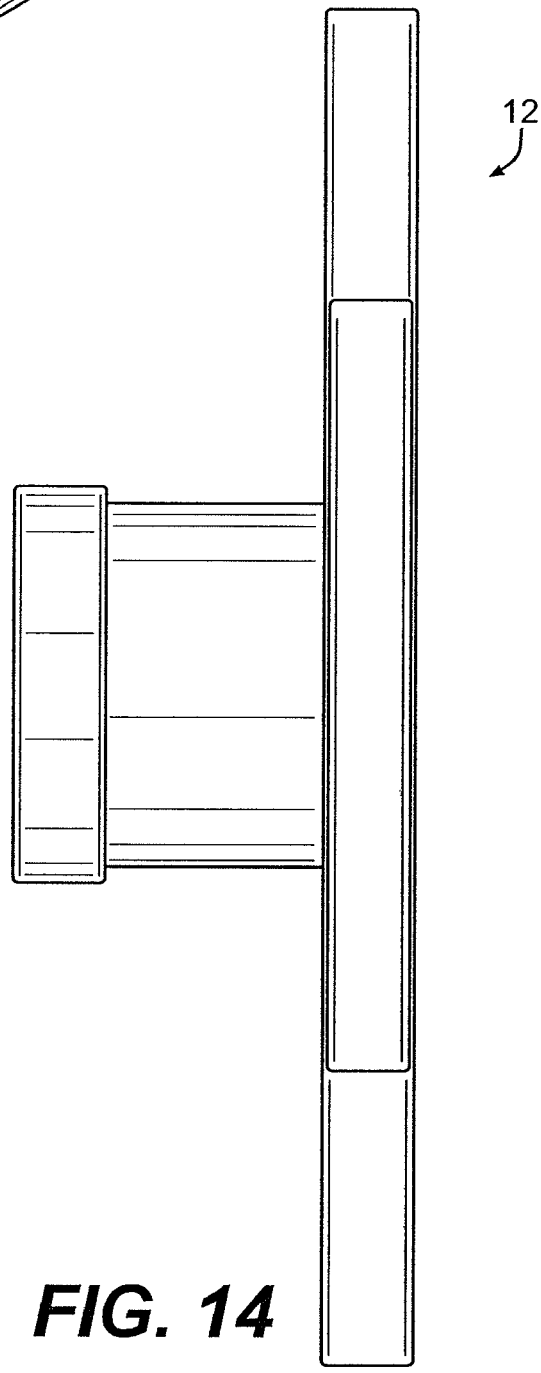
FIG. 14 is a side elevation view of the mounting base of the bell button of FIG. 1.

Referring now to the drawing figures, wherein like part numbers refer to like elements throughout the several views, there is shown in FIGS. 1, 2, 3, 4, 4A and 5 a door bell button 10 for activation of a door bell in accordance with a first preferred embodiment of the present invention. The door bell button 10 includes a mounting base 12 (see FIGS. 3, 5, 7-9 and 14), for attachment adjacent to a door, by, for example, flat head screws through screw holes 14 in the mounting base 12 that may be attached to a surface (not shown) adjacent to a door, for example, on a door jamb. An electronic switch 16, preferably a high quality sealed and lighted switch (for example, a switch manufactured by NKK Switches, Inc. of Scottsdale Ariz., part number KB15CK), is rigidly secured to the mounting base 12. The switch 16 has a lighted actuator plunger 18 that, prior to assembly into the door bell button 10 of the present invention is capable of moving along an axis perpendicular to the mounting base 12 by a first length A (see FIG. 3). A decorative cover 20 (see alternate embodiments of the decorative cover 20,20A in FIGS. 4A and 4B) is secured to the mounting base 12 by a hollow retaining ring 22 (see FIGS. 1, 2, 3, 5, 6, 8-10 and 12).

A translucent bell button shaft 24 is provided that has a first end 26 and a second end 28 (see FIGS. 2, 3 and 5-11). The first end 26 is secured to a button paddle 30, the second end 28 is slidably disposed in the retaining ring 22 such that the bell button shaft 24 is captured by the retaining ring 24 but is capable of limited movement along the axis X (perpendicular to the mounting base). The bell button shaft 24 is preferably capable of movement along the axis X by a second length B (see FIG. 3). Here, the second length B is shorter than the first length A such that the actuator plunger 18 is never fully depressed. Therefore, the life of the switch 16 is likely extended relative to a switch that bottoms out (actually travels during use the distance A).

Preferably, the hollow retaining ring 22 has an inwardly extending annular ring 32 and the bell button shaft 24 has an outwardly extending annular ring 34 that is larger than the inwardly extending annular ring 32 of the retaining ring 22 such that the bell button shaft 24 that is captured by the retaining ring 22 is slidably disposed in the retaining ring 22 such that limited movement along the axis perpendicular to the mounting base is possible. The retaining ring 22 is secured to the mounting base 12 by, for example, internal threads on the base 12 and external threads on the retaining ring 22 (not shown).

Light from the lighted actuator plunger 18 shines through the translucent bell button shaft 24 to light the shaft 24, preferably creating a halo effect of light around the paddle button 30, which, preferably, is opaque. Alternatively, the paddle button 30 may be omitted and, if so, the bell button shaft is directly used as the button to actuate the door bell.

The installation of the bell button 10 is as follows:

First, the mounting base 12 with the lighted switch 16 installed is screwed to the door frame. The wires connecting the door bell button 10 to a door bell located inside a house (not shown) have previously been fished to the location and connected to the switch 16. The decorative cover 20 is applied over the mounting base 12 and switch 16.

Next, the retaining ring 22 is assembled with the bell button shaft 24 and paddle button 30. As stated previously, the bell button shaft 24 has an annular ring 34 that captures it in the retaining ring 22. The paddle button 30 is screwed to the first end 26 of the bell button shaft 24.

The retaining ring 22 then is screwed into place affixing the decorative cover 20 in place on the mounting base 12. When the paddle button 30 is fully depressed, the switch is operated, but before the switch reaches its fully depressed (mechanical) position, the bell button shaft 24 has already bottomed out, protecting the switch from physical damage. The lighted switch 16 is protected from direct exposure to weather as well as UV rays. This prevents the degradation of the plastic from exposure to sunlight. The light from the switch 16 is, however, transmitted through the bell button shaft 24 so that the switch has a gentle ambient glow.

Figure 15:
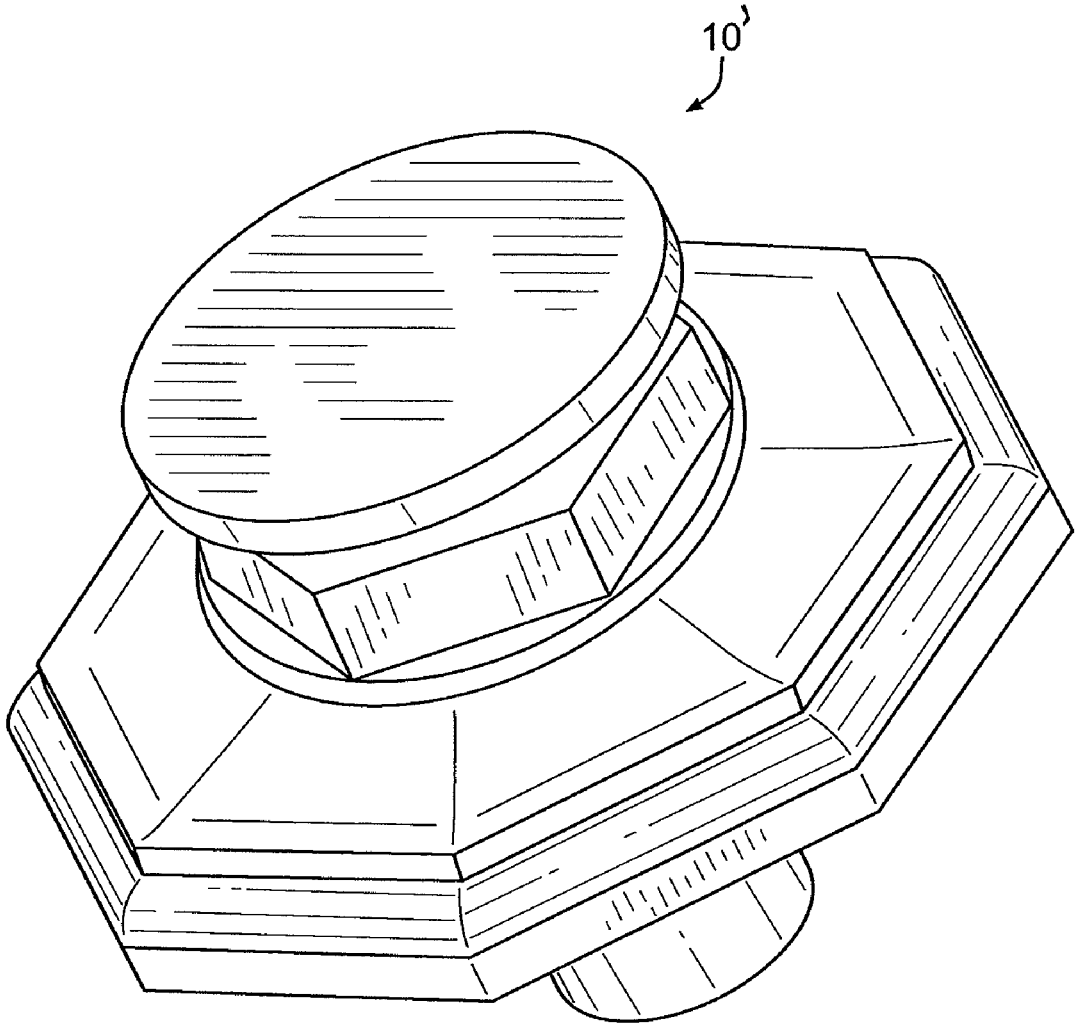
FIG. 15 is an isometric view of a bell button in accordance with a second preferred embodiment of the present invention.
Figure 16:
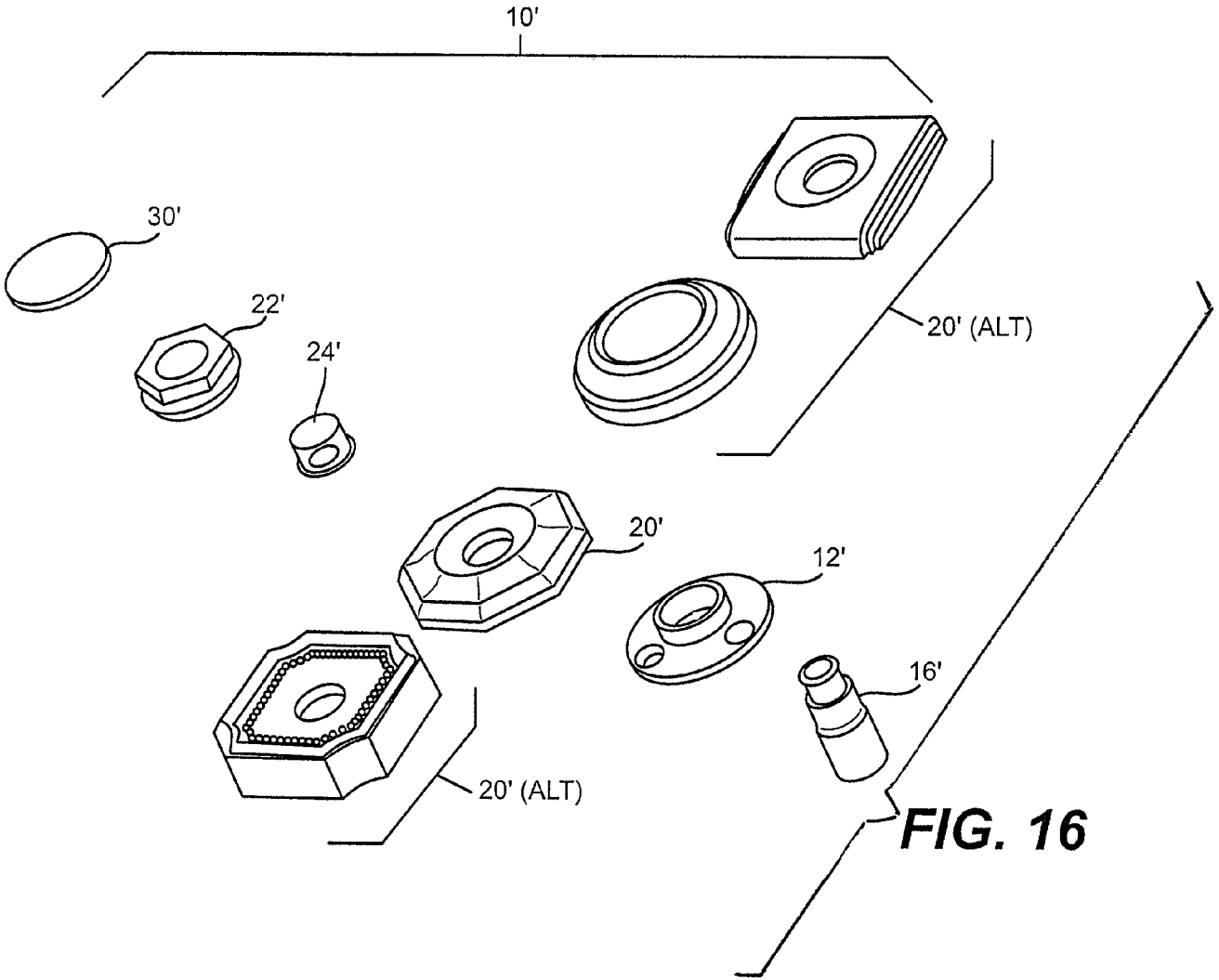
FIG. 16 is an exploded isometric view of the second preferred embodiment of FIG. 15, shown with three alternate decorative covers.

FIGS. 15 and 16 depict an alternate embodiment of a bell button 10' in accordance with another preferred embodiment of the present invention. Here, generally, only the mounting base 12' and the decorative cover 20' are different, yielding a bell button 10' having identical function as the bell button 10 of the previous figures.

While the invention has been described in detail and with reference to specific embodiments thereof, it will be apparent to one skilled in the art that various changes and modifications can be made therein without departing from the spirit and scope thereof.

What is claimed is:

1. A door bell button for activation of a door bell, comprising:

(a) a mounting base for attachment to a surface adjacent to a door;

(b) a switch, said switch secured to said mounting base and having a lighted actuator plunger, wherein the switch and the lighted actuator assembly are a single integral unit; and (c) a translucent bell button shaft having a first end and a second end, the second end abutted against the lighted actuator plunger, the shaft slidably disposed and capable of limited movement along an axis perpendicular to the mounting base, wherein movement of the bell button shaft toward the switch depresses the lighted actuator plunger of the switch;

whereby light from the lighted actuator plunger shines through the translucent bell button shaft to light the shaft.

2. The door bell button of claim 1, wherein the actuator plunger is capable of movement along an axis perpendicular to the mounting base by a first length and the bell button shaft is capable of movement along the axis perpendicular to the mounting base by a second length, and wherein the second length is shorter than the first length such that the actuator plunger is never fully depressed.

3. The door bell button of claim 1, including a cover secured to the mounting base by a hollow retaining ring.

4. The door bell button of claim 1, wherein the first end of the translucent bell button shaft is secured to a button paddle, and the second end of the translucent bell button shaft is slidably disposed in the retaining ring such that the bell button shaft is captured by the retaining ring but is capable of the limited movement along the axis perpendicular to the mounting base.

5. A door bell button for activation of a door bell, comprising (a) a mounting base for attachment to a surface adjacent to a door;

(b) a switch, said switch rigidly secured to the mounting base, the switch having a lighted actuator plunger that moves along an axis perpendicular to the mounting base by a first length, wherein the switch and the lighted actuator plunger are a single integral unit;

(c) a cover secured to the mounting base;

(d) a hollow retaining ring to secure the cover to the mounting base; and (e) a translucent bell button shaft having a first end and a second end, the first end secured to a button paddle, the second end abutting the lighted actuator plunger, the shaft being slidably disposed in the retaining ring such that the bell button shaft is captured by the retaining ring but is capable of limited movement along the axis perpendicular to the mounting base, wherein movement of the bell button shaft toward the switch depresses the lighted actuator plunger of the switch;

whereby light from the lighted actuator plunger shines through the translucent bell button shaft to light the shaft.

6. The door bell button of claim 5, wherein the bell button shaft is capable of movement along the axis perpendicular to the mounting base by a second length and wherein the second length is shorter than the first length such that the actuator plunger is never fully depressed.

7. The door bell button of claim 5, wherein the cover is a decorative cover.

8. A method of installing a bell button for activation of a door bell, comprising:

(a) attaching a bell button mounting base to a surface adjacent to a door;

(b) rigidly securing a switch to the mounting base, the switch having a lighted actuator plunger that moves along an axis perpendicular to the mounting base by a first length, the switch and the lighted actuator plunger being a single integral unit; and (c) securing a first end of a translucent bell button shaft to a button paddle, and capturing the bell button shaft such that the bell button shaft is capable of limited movement along the axis perpendicular to the mounting base, wherein movement of the bell button shaft toward the switch depresses the lighted actuator plunger of the switch whereby light from the lighted actuator plunger shines through the translucent bell button shaft to light the shaft.

* * * * *